US007841205B2

(12) United States Patent
Hugelman

(10) Patent No.: US 7,841,205 B2
(45) Date of Patent: Nov. 30, 2010

(54) INTEGRATED COMPRESSOR/EXPANSION ENGINE

(75) Inventor: Rodney Dale Hugelman, Oviedo, FL (US)

(73) Assignee: Whitemoss, Inc., Champaign, IL (US)

( * ) Notice: Subject to any disclaimer, the term of this patent is extended or adjusted under 35 U.S.C. 154(b) by 460 days.

(21) Appl. No.: 11/990,607

(22) PCT Filed: Aug. 8, 2006

(86) PCT No.: PCT/US2006/030759

§ 371 (c)(1),
(2), (4) Date: Feb. 17, 2008

(87) PCT Pub. No.: WO2007/021651

PCT Pub. Date: Feb. 22, 2007

(65) Prior Publication Data

US 2009/0249826 A1 Oct. 8, 2009

Related U.S. Application Data

(60) Provisional application No. 60/708,533, filed on Aug. 15, 2005.

(51) Int. Cl.
*F25D 9/00* (2006.01)

(52) U.S. Cl. ..... 62/401; 62/498

(58) Field of Classification Search ..... 62/498, 62/401, 402, 499, 238.1, 116, 87; 60/525, 60/651; 414/364, 397
See application file for complete search history.

(56) References Cited

U.S. PATENT DOCUMENTS

| | | | | |
|---|---|---|---|---|
| 4,235,079 | A * | 11/1980 | Masser | 62/87 |
| 4,455,837 | A * | 6/1984 | Firey | 60/670 |
| 5,038,583 | A * | 8/1991 | Gali | 62/498 |
| 6,138,457 | A * | 10/2000 | Lackstrom et al. | 60/651 |
| 6,185,956 | B1 * | 2/2001 | Brasz | 62/498 |
| 6,530,979 | B2 * | 3/2003 | Firey | 95/270 |
| 6,601,547 | B2 * | 8/2003 | Al-Hawaj | 123/56.1 |
| 6,606,860 | B2 * | 8/2003 | McFarland | 60/648 |
| 6,653,004 | B1 * | 11/2003 | Barber | 429/430 |
| 6,877,340 | B2 * | 4/2005 | Hiwata et al. | 62/527 |
| 7,040,278 | B2 * | 5/2006 | Badgley | 123/204 |
| 2003/0061818 | A1 * | 4/2003 | Nash et al. | 60/784 |
| 2004/0050246 | A1 * | 3/2004 | Takahashi et al. | 91/491 |
| 2004/0112601 | A1 * | 6/2004 | Hache | 166/302 |
| 2004/0200350 | A1 * | 10/2004 | Makino et al. | 91/499 |
| 2004/0216602 | A1 * | 11/2004 | Matsumoto et al. | 91/499 |

* cited by examiner

*Primary Examiner*—Mohammad M Ali
(74) *Attorney, Agent, or Firm*—Knechtel, Demeur & Samlan

(57) ABSTRACT

A multi cylinder compressor/expansion engine having a centrally mounted drive shaft. A cylinder barrel is mounted on the drive shaft and both the cylinder barrel and the drive shaft rotate about a common axis. There is a plurality of cylinders in the cylinder barrel with pistons disposed in each of the cylinders. Some of the cylinders are compression cylinders and some of the cylinders are expansion cylinders. The compression cylinders discharge a fluid at a first high pressure from the engine. The expansion cylinders receive fluid at a second pressure which provides energy to the engine thereby reducing the energy required for the engine to rotate the drive shaft.

31 Claims, 5 Drawing Sheets

INTEGRATED COMPRESSOR/EXPANSION ENGINE

CROSS-REFERENCE TO RELATED APPLICATION

This patent application claims priority from U.S. Provisional Application Ser. No. 60/708,533 filed on Aug. 15, 2005.

I. BACKGROUND AND SUMMARY OF THE INVENTION

This invention relates to a process which utilizes an axial compressor which integrates into itself a compressor and expansion engine.

A schematic diagram of an air conditioning system as known in the prior art is shown in FIG. 1. Air conditioning systems use the process of using a compressor 10 to compress a gas to high pressure 11 which makes it hot. This hot gas 11 is then cooled down in a heat exchanger or condenser 12. Generally a fan 14 forces cool air over or through the heat exchanger 12 to produce a cooled gas 13. The cooled gas 13 then passes through a throttling valve 16 which allows the cooled gas 13 to expand to a low pressure which creates a cold gas 17. The cold gas 17 then passes through another heat exchanger or evaporator 18, where a second fan 20 forces air over or through the evaporator 18 so that heat can be removed from the intended environment such as an automobile, home air conditioner, refrigerator, etc. The exiting low pressure gas 21, now warmed, is returned to the compressor 10 where the cycle is repeated.

In the air conditioning system illustrated in FIG. 1, cooling took place by expanding the gas from a high pressure to a low pressure through the throttling valve 16. This is an inefficient process, producing the desired cooling effect, but with no work being done during the expansion process.

It is commonly known to use air to power various devices. For example, in an auto shop air wrenches are used to remove lug nuts from wheels. Air tools are used because they are compact, powerful, reliable and, unlike electric tools, remain cool during use. If one holds his hand over the air tool exhaust he would feel the cool air exiting the tool. This process duplicates precisely the effect employed in common air conditioning systems, shown in FIG. 1 above.

As can be seen in FIG. 2, by replacing the throttling valve 16 of FIG. 1 with an expansion gas operated motor 22, the same cooling will be achieved but with positive work being produced. This is accomplished by means of a mechanical coupling 24 connecting the expansion engine 22 to the compressor 10. This energy can be used to help drive the compressor 10, thereby reducing the system energy requirements significantly. Energy savings on the order of 30% are not unreasonable.

The problem in implementing the system as illustrated in FIG. 2 is the difficulty in mechanically coupling the separate expansion device 22 to the compressor 10. Further, the work energy recovery is not as hoped for due to the lower operating pressure levels used in typical air conditioning systems. However, the air conditioning community has now banned fluorocarbons from the environment and is moving rapidly away from the use of low pressure hydrofluorocarbons and to high pressure $CO_2$ gas refrigeration. The use of high pressure $CO_2$ enhances the performance advantages expected from expansion devices. Energy savings of over 35% have been achieved with such test systems. The problem of coupling or returning that energy to the compressor system is still unresolved.

II. SUMMARY OF THE INVENTION

To simplify the use of the expansion engine, a new compressor design has been developed which integrates the expansion engine with the compressor itself. A multi-cylinder axial engine is used with two separated sets of input/output ports. The port sets are isolated from each other but are concentrically located about the drive shaft. The outer port ring is used to control the input/output of the compressor function and the inner port ring is used to control the input/output of the expansion engine. The multiple pistons are then ported through the cylinder head opening to access either the inner or outer ring of ports. The user can then mix the piston set by selecting the desired cylinder head ports to alter the ratio of compression cylinders to expansion cylinders. For example, a nine cylinder set could be ported so that five cylinders are used for air conditioning compression with the remaining four ported for gas expansion to drive the pistons, such as in a $CO_2$ gas motor or engine. Since all of the pistons are driven by, or drive, the same shaft there is no change in the parts count or complexity. Five piston/cylinders compress the working gas for the refrigeration cycle and the remaining four receive the high pressure working gas and operate as a motor, expanding the gas and returning work to the same drive shaft. All pistons are reciprocated as they follow the angled wedge face as the cylinder is rotated. Those pistons which are used for compression work are powered by the rotating shaft and cylinder. Those pistons used for energy recovery add work back to the cylinder and shaft as the high pressure gas is expanded through those cylinders.

Since the compressor uses a split cylinder/head arrangement, the user can alter the compression/expansion set ratio, or split, by changing out the replaceable cylinder head. A range of cylinder heads could be kept on hand to customize any given compressor.

A further embodiment of this invention uses a unique $CO_2$ compressor configuration capable of dynamically altering the compressor displacement as well as the compressor pressure ratio, each independently of each other. This is achieved by independently changing the wedge angle while the shaft is rotating the cylinder/piston sets. Thus the reciprocating stroke is changed which changes the displacement. A further embodiment is to move the position of the wedge axially which would independently change the piston top-dead-center clearance volume and, therefore, the compression ratio. Collectively, this would produce a compressor which could independently and dynamically:

1. Adjust compressor displacement,
2. Adjust compressor compression ratio,
3. Recover A/C cycle expansion energy.

Computer control of these compressor factors allow for broader environmental application, optimum performance, at optimum efficiency. Any improvement in efficiency results in a smaller, more compact, and less expensive system for the same cooling performance (or heating performance for heat pump cycles).

To summarize, the compressor will allow a modern $CO_2$ system, under computer control, to size the compressor and to change the compression ratio, as required, and to produce improved performance and efficiency for any given installation under most environmental conditions. The integrated expansion engine would also have its coupled performance seamlessly altered in synchronization with any changes in the performance of the compressor side.

III. OBJECTS AND ADVANTAGES

It is an object of the invention to provide a new engine that integrates both a compression engine and an expansion engine into one device. It is a related object to provide a new integrated expansion/compression engine into a multi-cylinder axial engine. Yet another object is to provide both expansion cylinders and compression cylinders which are coupled to a common shaft. A related object is to provide both expansion and compression cylinders concentrically disposed about a common shaft.

It is another object to provide a multi-cylinder expansion/compressor engine having isolated sets of input and output ports in which one ring of ports controls the compressor function and another ring of ports controls the expansion function.

Yet another object to provide an expansion/compression engine in which the user selects the ratio of compression cylinders to expansion cylinders.

It is an advantage of the expansion/compression engine to use both compression cylinders and expansion cylinders coupled to one shaft as it provides energy savings over conventional compression engines while retaining compressor compactness and configuration.

IV. BRIEF DESCRIPTION OF THE DRAWINGS

V. DESCRIPTION OF THE PREFERRED EMBODIMENT

Figure 4:
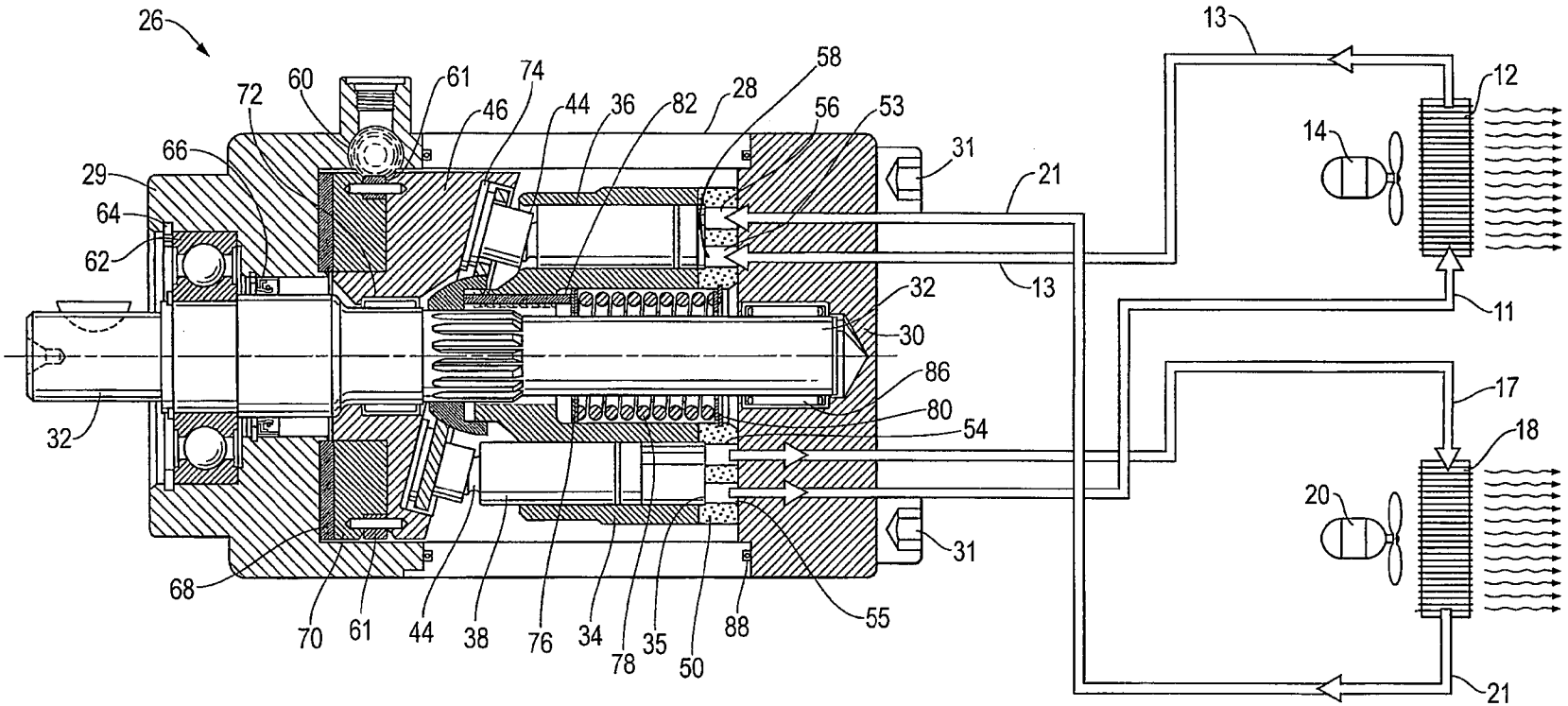
FIG. 4 is a schematic diagram of an expansion/compression engine with the expansion/compression engine shown in cross section.

Turning to FIG. 4, there is illustrated a multi-cylinder axial compression/expansion engine 26 referred to herein as engine 26 of the present design. The engine 26 is contained within a main housing or case 28 having a top or front end 29 and a rear or port end 30. Case bolts 31 extend through the main housing 28 to secure the housing and its components yet allow access to the components when required. A drive shaft 32 spins a cylinder barrel 34 containing at least one expansion cylinder 36 and at least one compression cylinder 38. The cylinder barrel has a head end 35 adjacent to the rear or port end 30. There is a piston foot 44 at one end of each of the pistons opposite the head end 35 with the other end of each piston extending into each of the cylinders 36, 38. The pistons 40, 42 cycle as the cylinder barrel 34 is spun by the drive shaft 32. There is a wedge 46 at the top or front end 29 that causes the pistons 40, 42 to reciprocate as the cylinder barrel 34 is spun. The term "wedge" used throughout this application is meant to include a wobble plate, wedge swashplate and swashplate. Near the rear or port end 30 of the cylinder barrel 34 is a fixed port plate 50 (also seen in FIG. 9).

Figure 9:
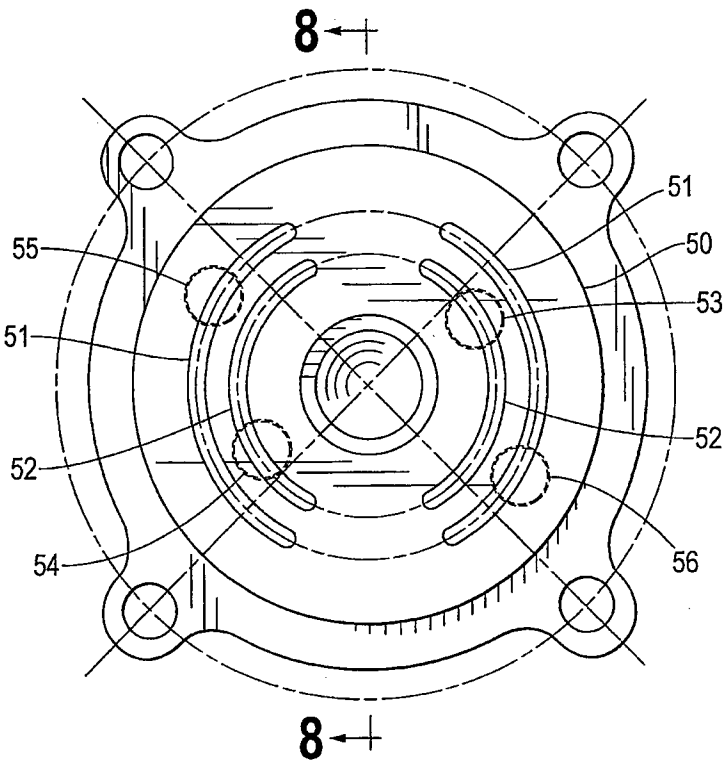
FIG. 9 is an end view of the end cap port plate showing the location of the expansion and compression ports.

Four bored inlet/outlet slots are shown in FIG. 9 as slots 51, 52, 53 and 54. One concentric pair is the inlet/outlet slots for the compression cycle of the engine 26 and the other concentric pair are the inlet/outlet slots for the expansion cycle of the engine 26. One slot of a concentric pair is the inlet slot and the other is the outlet slot for the compression or expansion cycles of the engine as the case may be. In the following description, piston rotation is counterclockwise, and the outer concentric pair is the inlet/outlet slots for the compression cycle of the engine 26. As seen in FIG. 9, the first outside slot is a compression cycle high pressure outlet slot 52. There is a first inside slot 53 which is the expansion cycle lower pressure inlet. There is a second inside slot 54 which is an expansion cycle low pressure outlet slot. Finally, there is a second outside slot 51 which is the compression cycle low pressure low pressure inlet. The cylinders and pistons function in the compression cycle if they are ported to the compression cycle inlet/outlet slots 51, 52. They function in the expansion cycle if they are ported to the expansion cycle inlet/outlet slots 53, 54.

The compression cycle operates as in a conventional axial compressor. The compression cylinders 38 and compression pistons 42 are disposed circumferentially about the drive shaft 32 within the cylinder barrel 34. There are compression piston cylinder ports 55 (FIG. 7) in the head end 35 of the rotating cylinder barrel 34 that pass over the compression cycle inlet and outlet slots 51, 52. of the compression ports 55, 56. During operation of the engine 26, a low pressure charge is drawn in through the compression inlet slot 51 and a high pressure charge is delivered at the compression outlet slot 52. When the low pressure charge is drawn in and when the high pressure charge is delivered, the compression piston cylinder ports 55 are aligned with and in fluid communication with either the compression cycle low pressure inlet slot 51 or the compression cycle high pressure outlet slot 52 respectively.

The expansion cycle operates as follows. The expansion cylinders 36 and expansion pistons 40 are also circumferentially disposed about the drive shaft 32 within the cylinder barrel 34. There are expansion piston cylinder ports 56 (FIG. 7) in the head end 35 of the rotating cylinder barrel 34 that pass over the expansion cycle inlet slot 53 and expansion cycle low pressure outlet slot 54. During operation of the engine 26, the lower pressure charge from the compression cycle enters through the expansion cycle inlet slot 53 and exerts pressure against expansion pistons 40 driving rotation of drive shaft 32 thereby reducing the energy required for engine 26 to rotate drive shaft 32 in the same direction. A low pressure expansion charge is delivered to the expansion cycle low pressure outlet slot 54. Similar to the compression cycle, the expansion cycle inlet slot 53 or expansion cycle low pressure outlet slot 54 is aligned with and in fluid communication with the expansion piston cylinder port 56 when the charge enters or discharged from the expansion cylinder 36 respectively.

The port plate 50 and expansion and compression slots 51-54 are fixed in position relative to the main housing 28 while the wedge 46 can be rotated around the drive shaft 32 which is the axis of the engine 26. A worm drive assembly 60 mounted near the front end 29 of housing 28 drives a worm gear 61 that in turn rotates the wedge 46 about the axis of the drive shaft 32. This controls the effective flow rate of the pistons 40, 42 and thus controls the amount of fluid received or pumped during one cycle of the piston. Other means of controlling displacement of the pistons are known in the art such as illustrated in U.S. Pat. Nos. 5,724,879 and 5,979,294 and 6,629,488, all incorporated herein by reference.

FIG. 4 illustrates the other components of the engine 26. The stationary components will be addressed first. There is a main bearing 62 press fitted into the front housing 29. The bearing 62 is secured with a snap ring 64. There is a drive shaft oil seal 66 that is secured within the front housing 29 around the drive shaft 32. There is a Teflon® thrust bearing 68 fitted into the inner face of the front housing 29. The worm drive assembly 60 is attached to a wedge thrust collar 70. A needle bearing 72 is press fitted in the wedge 46 around the drive shaft 32. The worm drive assembly 60 must drivingly engage the worm gear 61 so that when the worm drive assembly 60 is activated it rotates the worm gear 61 which in turn rotates the wedge 46. The wedge 46 may have a smooth slipper plate 74 installed on its angled face.

The rotating components will now be discussed also with reference to FIG. 4. Cylinder barrel spacers 76, spring 78 and snap ring 80 are all installed into the cylinder barrel 34. Dowel thrust pins 82 are installed into holes in the foot end of the cylinder barrel 34. A ball seat 84 is mounted on the foot end of the cylinder barrel 34. An expansion or compression piston 40 or 42 is inserted into each cylinder 22 through the end of the cylinder barrel 34 opposite the head end 35 of the cylinder barrel. In the preferred embodiment there are nine piston assemblies equally positioned around the cylinder barrel 34. The dowel thrust pins 82 compress the spring 78 holding the head end of the cylinder barrel and its cylinder face against the port plate 50. The piston foot 44 is held firmly against the slipper plate 74 which in turn is pressed against the wedge 46 and against the thrust bearing 68. The drive shaft 32 is retained within needle bearings 86 in the rear or port end 30 of the housing 29. The port plate 50 is positioned and sealed within the main housing 28 by O-rings 88 and any necessary retaining means. The case bolts 31 secure the main housing 28 with all internal components securely fastened or positioned within.

The pistons 40, 42 move through one complete stroke with each complete rotation of the of the cylinder barrel 34. The pistons 40, 42 move within cylinders 36, 38 from a top dead center point to a bottom dead center point. The flow control is generally controlled by adjusting the angle of the wedge 46 which in turn varies the distance a piston travels within the cylinder and thus the amount of fluid pumped with each stroke. Alternative flow control means are known in the art such moving the entire wedge forward or backward which accomplishes the same purpose of varying the amount of fluid received within a cylinder in a given cycle.

Figure 2:
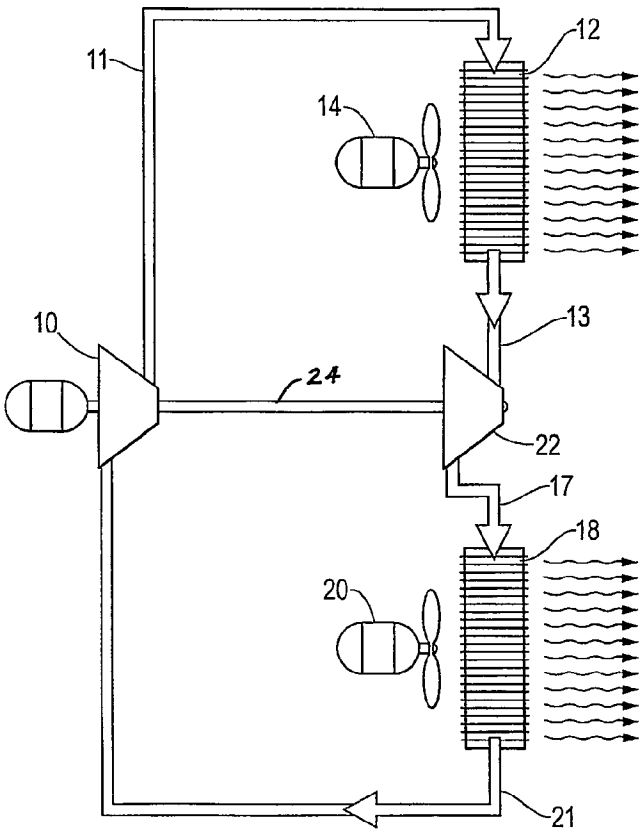
FIG. 2 is a schematic diagram of an expansion and compression engine coupled to a common shaft.
Figure 1:
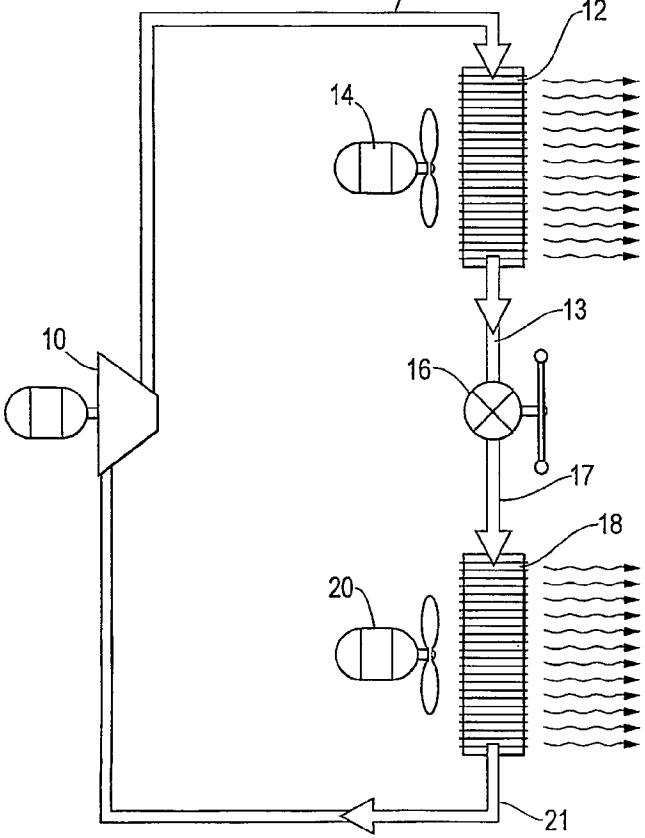
FIG. 1 is a schematic diagram of a conventional prior art air conditioning system.
Figure 7:
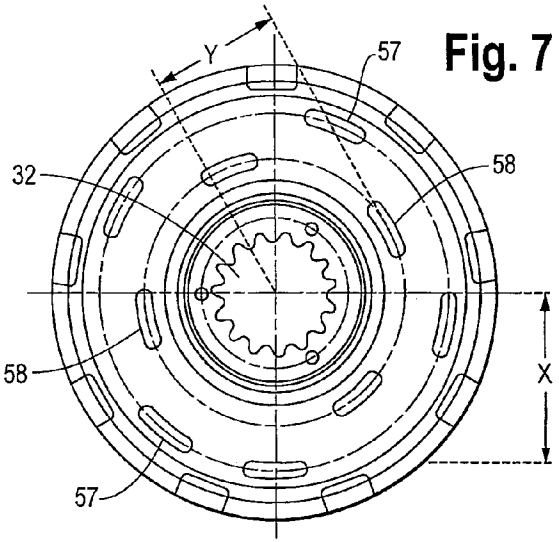
FIG. 7 is an end view of the head of the expansion/compression engine showing the location of the compressor ports and expansion ports disposed radially about the shaft.
Figure 5:
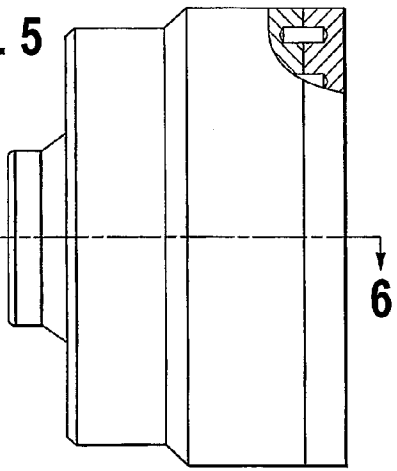
FIG. 5 is a side view, partially in cross section, of the cylinders and head of the expansion/compression engine.
Figure 6:
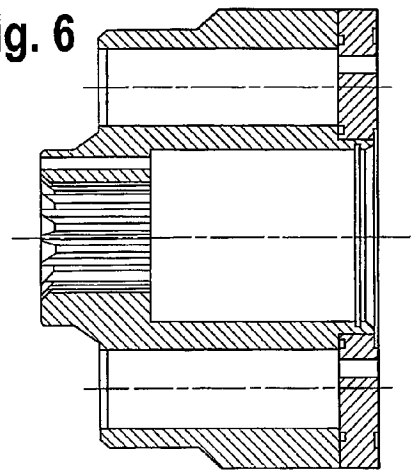
FIG. 6 is a cross section taken along line 6-6 of FIG. 5 showing the location of the compressor ports and expansion ports in the head.
Figure 10:
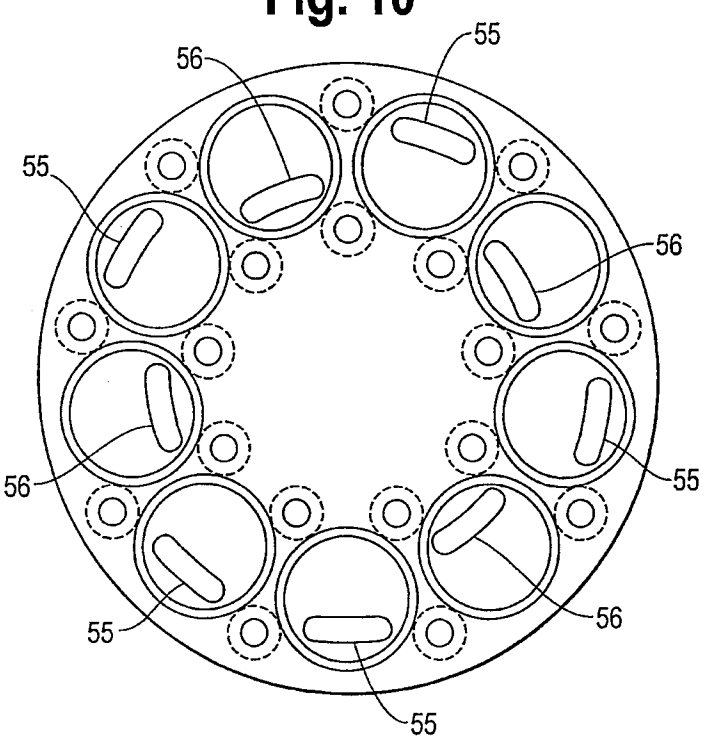
FIG. 10 is an end view of the end cap port plate showing the location of the expansion and compression ports in relation to the cylinders.
Figure 8:
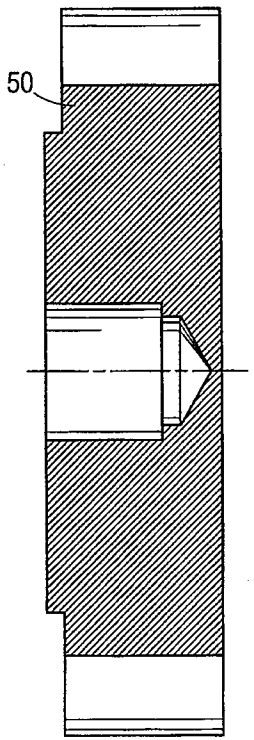
FIG. 8 is a side view in cross section showing the end cap port plate.

This engine is unique in that the cylinder barrel 34 has both expansion cylinders 36 and compression cylinders 38 within the same cylinder barrel. Thus the expansion cylinders are not mechanically coupled to the drive shaft by any additional mechanical coupling other than the same drive shaft that drives the compression pistons. The ratio of expansion cylinders 34 and compression cylinders 36 can be easily altered by changing the cylinder head 35. As seen in FIG. 7, there are five compression cylinder openings 55 in the head end 35 of the cylinder barrel 34. There are four expansion cylinder openings 56 in the head end 35 of the cylinder barrel 34. The operation of the engine 26 has been previously described. The engine 26 implements the concepts disclosed in FIG. 2 into the system illustrated in FIG. 4.

FIG. 4 illustrates replacing the compressor 10 with the engine 26. The compression cylinders 38 and compression pistons 42 compress the gas, which is preferably $CO_2$, to a high pressure, approximately 1800 psi with the compression raising the temperature of the gas to a high temperature. The high pressure high temperature gas 11 is discharged through the compression piston cylinder port 55 to the compression cycle high pressure outlet slot 52. The gas 11 then enters and passes through the condenser 12 where a fan 14 forces cool air over the condenser 12 producing a cooled gas 13. The cooled gas 13 is then directed back to the engine 26 where it is received through the expansion cycle inlet slot 53 and passes through the expansion piston cylinder port 56. The energy received in the expansion cylinder 36 in the form of positive fluid pressure helps drive the engine 26. The gas 13 is cooled further as a result of its expansion. It is then discharged from the expansion cylinder 36 through the expansion piston cylinder port 56 as cold gas 17 at a pressure of about 500 psi.

The cold gas 17 then passes through the heat exchanger or evaporator 18, where the second fan 20 forces air over or through the evaporator 18. This cooled air removes heat from the intended environment to be cooled. The cool low pressure gas 21 is still at approximately 500 psi and is returned to the compression cycle low pressure inlet slot 51. From here it enters the compression cylinder port 55 and enters the compression cylinder 38 where the cycle is repeated.

The number of compression and expansion cylinders in an application is easily varied by removing the split cylinder/head and substituting another cylinder head with a different number of expansion and compression cylinders. As described herein, there were a total of nine cylinders, but other configurations can be used.

As seen in FIG. 7 the compression cylinder ports 55 are placed at a radial distance "x" from the center of the drive shaft 32. The expansion cylinder piston openings 58 are placed a radial distance "y" from the center of the drive shaft 32. As illustrated, the distance "x" is greater than "y", however, the expansion cylinder piston openings and compression cylinder openings could be reversed if one had a specific mechanical preference. The point is that the compression cylinder openings and expansion cylinder openings are placed at different radial distances from the center of the drive shaft 32 so that they operate independently of each other as separate engines.

The compression ratio can be changed by rotating or axially moving the wedge, depending on the control system used in the given engine. This is commonly known in the art of axial compressors/pumps. It can either be manually controlled or computer controlled with conventionally known control systems.

Figure 3:
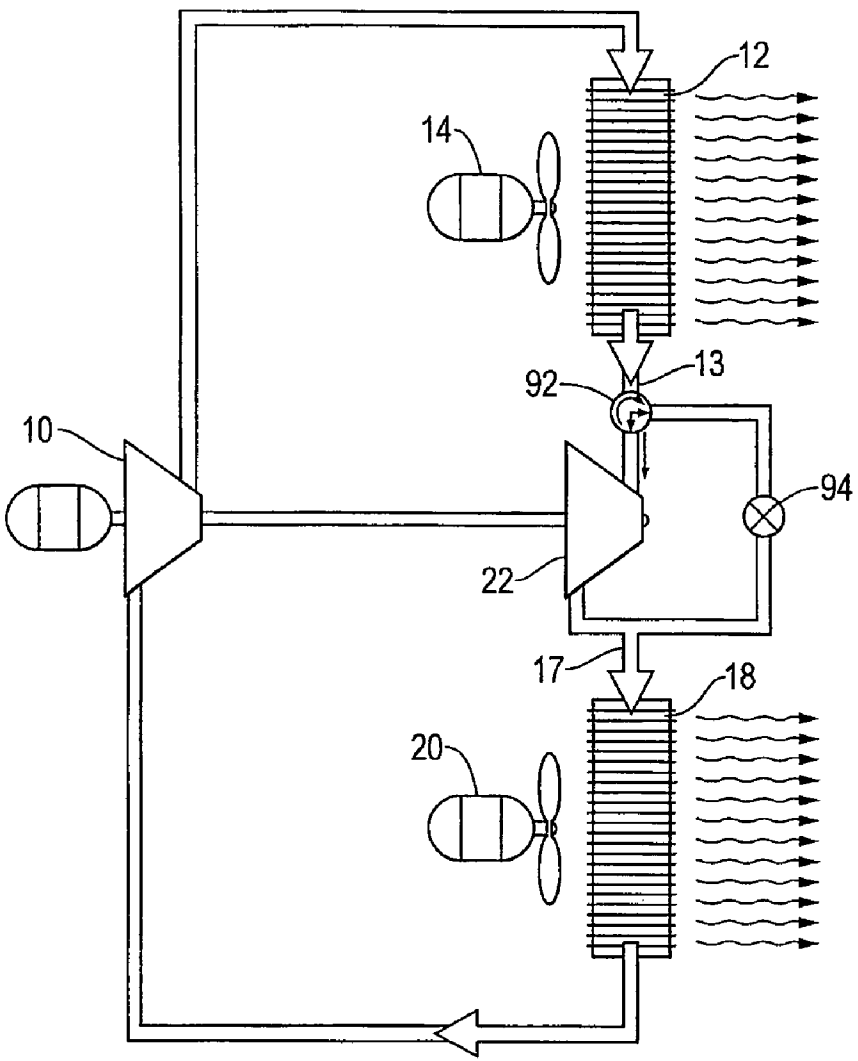
FIG. 3 is a schematic diagram of an alternate embodiment of an expansion and compression engine having a diversion control valve and a throttling valve for adjusting the amount of expansion boost delivered to the compressor.

In an alternate embodiment as seen in FIG. 3, a diversion control system 90 is added. This includes a diversion control valve 92 added at the output of the heat exchanger or condenser 12. This diverts a controlled amount of the cooled gas 13 to either the engine 26 or to a throttle valve 94. The throttle valve allows a bypass of the gas 13 to the evaporator 18. This permits the adjustment of the amount of expansion boost delivered to the engine 26.

Thus there has been provided an integrated compressor and expansion engine that fully satisfies the objects set forth above. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A compressor/expansion engine comprising:

a centrally mounted drive shaft, a cylinder barrel mounted on the drive shaft, the cylinder barrel and the drive shaft rotating about a common axis of rotation, a plurality of cylinders disposed in the barrel, a piston disposed in each of the cylinders, the piston defining a piston stroke as it reciprocates in the cylinder, at least one of the cylinders being a compression cylinder for discharging a fluid at a first pressure from the compressor/expansion engine, and at least one of the cylinders being an expansion cylinder for receiving a fluid at a second pressure for providing energy to the compressor/expansion engine.

2. The compressor/expansion engine of claim 1 and further comprising a wedge member mounted in the engine, the wedge member in driving relationship with the pistons for causing the pistons to reciprocate when the cylinder barrel is rotated with respect to the wedge member.

3. The compressor/expansion engine of claim 2 wherein the wedge member is adjustable for adjusting the piston stroke.

4. The compressor/expansion engine of claim 2 wherein the wedge member is moveable for adjusting the piston stroke and clearance volume within the cylinder.

5. The compressor/expansion engine of claim 1 and further comprising a cylinder head with porting means for providing fluid passages into and out from the cylinders.

6. The compression/expansion engine of claim 5 wherein the porting means comprises a port plate disposed in the compressor/expansion engine at a port end of the cylinder barrel for providing the fluid passages into and out from the cylinders.

7. The compressor/expansion engine of claim 6 wherein the compression cylinder has compression cylinder ports located in the cylinder head at a first radial distance from the drive shaft and the expansion cylinder has expansion cylinder ports located in the cylinder head at a second radial distance from the drive shaft, and wherein the first and second radial distances are not the same.

8. The compressor/expansion engine of claim 7 wherein the cylinder head has expansion ports for receiving fluid at the second pressure and for providing it to the expansion cylinder for providing energy to the compressor/expansion engine.

9. The compressor/expansion engine of claim 8 wherein the cylinder head has compression ports for discharging fluid at the first pressure from the compression cylinder.

10. The compressor/expansion engine of claim 9 wherein the cylinder barrel is removable from the compressor/expansion engine and can be replaced by another cylinder barrel having a different ratio of expansion and compression cylinders.

11. The compressor/expansion engine of claim 10 wherein the port plate is removable and is replaced by another port plate having compression and expansion slots that correspond to the ratio of expansion and compression cylinders.

12. The compressor/expansion engine of claim 11 wherein the port plate has its compression slots and expansion slots aligned with their respective compression and expansion cylinder ports when the piston is at a top dead center position.

13. The compressor/expansion engine of claim 1 wherein the first pressure is between 200 psi and 1800 psi.

14. The compressor/expansion engine of claim 1 wherein the second pressure is between 200 psi and 1800 psi.

15. The compressor/expansion engine of claim 1 wherein the fluid is carbon dioxide.

16. An air conditioning system comprising:

condenser means with a high pressure hot fluid inlet and a high pressure warm fluid outlet, evaporator means with a low pressure cold fluid inlet and a cool low pressure fluid outlet, a compressor/expansion engine comprising a centrally mounted drive shaft, a cylinder barrel mounted on the drive shaft, a plurality of cylinders disposed in the barrel, a piston disposed in each of the cylinders, the piston defining a piston stroke as it reciprocates in the cylinder, at least one of the cylinders being a compression cylinder having a high pressure high temperature outlet for discharging a fluid at a first pressure from the compressor/expansion engine and a low pressure inlet, and at least one of the cylinders being an expansion cylinder having a high pressure high temperature inlet for receiving a fluid at a second pressure for providing energy to the compressor/expansion engine and a low pressure outlet, a first fluid passageway fluidly connecting the high pressure high temperature outlet from the compression cylinder to the high pressure hot fluid inlet of the condenser means, a second fluid passageway fluidly connecting the high pressure warm fluid outlet from the condenser means to the high pressure high temperature inlet of the expansion cylinder, a third fluid passageway fluidly connecting the low pressure outlet from the expansion cylinder to the low pressure cold fluid inlet of the evaporator means, and a fourth fluid passageway fluidly connecting the cool low pressure outlet from the evaporator means to the low pressure cold fluid inlet of the compression cylinder.

17. The air conditioning system of claim 16 and further comprising a wedge member mounted in the engine, the wedge member in driving relationship with the pistons for causing the pistons to reciprocate when the cylinder barrel is rotated with respect to the wedge member.

18. The air conditioning system of claim 17 wherein the wedge member is adjustable for adjusting the piston stroke.

19. The air conditioning system of claim 16 and further comprising a cylinder head with porting means for providing fluid passages into and out from the cylinders.

20. The compression/expansion engine of claim 19 wherein the porting means comprises a port plate disposed in the compressor/expansion engine at a port end of the cylinder barrel for providing the fluid passages into and out from the cylinders.

21. The compressor/expansion engine of claim 20 wherein the compression cylinder has compression ports located in the cylinder head at a first radial distance from the drive shaft and the expansion cylinder has expansion ports located in the cylinder head at a second radial distance from the drive shaft, and wherein the first and second radial distances are not the same.

22. The compressor/expansion engine of claim 21 wherein the cylinder head cylinder head has expansion ports for receiving fluid at the second pressure and for providing it to the expansion cylinder for providing energy to the compressor/expansion engine.

23. The air conditioning system of claim 22 wherein the cylinder head has compression ports for discharging fluid at the first pressure from the compression cylinder.

24. The air conditioning system of claim 16 wherein the cylinder barrel is removable from the compressor/expansion engine and can be replaced by another cylinder barrel having a different ratio of expansion and compression cylinders.

25. The air conditioning system of claim 23 wherein the port plate is removable and is replaced by another port plate having compression and expansion slots that correspond to the ratio of expansion and compression cylinders.

26. The air conditioning system of claim 25 wherein the port plate has its compression slots and expansion slots aligned with their respective compression and expansion cylinder ports when the piston is at a top dead center position.

27. The air conditioning system of claim 16 wherein the first pressure is between 200 psi and 1800 psi.

28. The air conditioning system of claim 16 wherein the second pressure is between 200 psi and 1800 psi.

29. The air conditioning system of claim 16 wherein the fluid is carbon dioxide.

30. A compressor/expansion engine comprising:

a housing having a centrally mounted drive shaft, a cylinder barrel mounted on the drive shaft, the cylinder barrel and the drive shaft rotating about a common axis of rotation, a plurality of cylinders disposed in the barrel, the cylinders oriented in spaced parallel relationship to the drive shaft with the cylinders having a long axis parallel to the axis of rotation, a piston disposed in each of the cylinders, the piston defining a piston stroke as it reciprocates in the cylinder, at least one of the cylinders being a compression cylinder for discharging a fluid at a first pressure from the compressor/expansion engine through a compression port, the compression port being located at a first radial distance from the axis of rotation, at least one of the cylinders being an expansion cylinder for receiving a fluid at a second pressure through an expansion port for providing energy to the compressor/expansion engine, the expansion port being located at a second radial distance from the axis of rotation which is different than the first radial distance.

31. The compression/expansion engine of claim 30 wherein the compression cylinder further comprises a low pressure inlet port located at the first radial distance and the expansion cylinder further comprises a low pressure outlet port located at the second radial distance.

* * * * *